United States Patent [19]

Waller

[11] 4,104,846

[45] Aug. 8, 1978

[54] CONTAINER LOADING MACHINE AND PROCESS

[76] Inventor: John G. Waller, 140 Old Fairburn Close, SW., Atlanta, Ga. 30331

[21] Appl. No.: 746,412

[22] Filed: Dec. 1, 1976

[51] Int. Cl.[2] ..... B65B 5/10; B65B 35/44

[52] U.S. Cl. ..... 53/26; 53/35; 53/62; 53/163; 53/164; 53/250; 214/6 F; 214/6 H

[58] Field of Search ..... 53/26, 35, 61, 62, 162, 53/163, 164, 244, 245, 248, 250, 251; 214/6 H, 6 DK, 6 F

[56] References Cited

U.S. PATENT DOCUMENTS

| | | | |
|---|---|---|---|
| 2,830,416 | 4/1958 | Edwards et al. | 53/163 |
| 2,921,702 | 1/1960 | Gross | 53/162 X |
| 2,956,384 | 10/1960 | Underwood | 53/164 X |
| 3,653,178 | 4/1972 | Bauer | 53/163 X |
| 3,673,756 | 7/1972 | Prete et al. | 53/248 X |

FOREIGN PATENT DOCUMENTS

| | | | |
|---|---|---|---|
| 1,314,057 | 4/1973 | United Kingdom | 53/35 |

*Primary Examiner*—Robert Louis Spruill
*Attorney, Agent, or Firm*—Newton, Hopkins & Ormsby

[57] ABSTRACT

A container loading machine which includes a frame through which a cross feed conveyor feeds successive open crates, containers or receptacles so as to position the open containers successively in the machine for receiving a plurality of layers of articles, such as egg cartons, therein, and for conveying each loaded container away from the machine. The machine includes a plurality of upstanding carton receiving rods, the ends of which project upwardly through the bottom of the container within the loading zone of the machine so that the upper ends stop adjacent the open top of the container in a position to receive the first layer of accumulated egg cartons from a storage zone, thereabove. An infeed carton conveyor, which includes a pair of spaced, flexible, opposed, endless belts, carry successive egg cartons to the storage zone.

17 Claims, 12 Drawing Figures

CONTAINER LOADING MACHINE AND PROCESS

BACKGROUND OF THE INVENTION

1. Field of the Invention:

This invention relates to a container loading machine and process and is more particularly concerned with both an apparatus and a process for successively loading containers with articles such as egg cartons.

2. Description of the Prior Art:

In the past, numerous stacking and unstacking machines have been devised. These machines, however, have usually been large complicated machines which subject the articles and the container for the articles to rough treatment. Therefore, in the past, the loading of egg cartons into containers has been essentially done by hand so as to assure that egg breakage is held to a minimum. Thus, a need has arisen for an inexpensive yet efficient machine and process for automatically loading the egg cartons into crates, the machine handling these cartons in a gentle way so as to eliminate breakage of the eggs during the loading operation.

The present invention is believed to have achieved this result.

SUMMARY OF THE INVENTION

Briefly described, the present invention includes an egg crate or container loading machine which has a container cross feed conveyor for successively conveying crates or containers to a loading zone and from a loading zone to a discharge carriage. In the loading zone, a plurality of carton supporting rods project upwardly through appropriate holes in the bottom of the egg crate so as to dispose the upper end of these rods in a common transverse plane generally above the open upper end of the container. Above and perpendicular to the container cross conveyor, is the carton infeed conveyor which conveys a plurality of successive egg cartons, sidewise, along a linear longitudinal path into a storage zone. The infeed carton conveyor includes a pair of quite flexible, spaced, opposed, endless belts which, when they ride upon supporting surfaces of opposed slide plates, will support the cartons by their end portions and, thus, convey the carton into the storage zone above the loading zone. On the other hand, when the belts are unsupported, the belts are sufficiently flexible that they gently lower the egg cartons into the loading zone, therebelow.

Below the upper and lower flights respectively of the opposed flexible belts are the pairs of spaced, opposed slide plates which are normally disposed so as to support the flights of the belts in their movement into and out of the storage zone so that a prescribed number of egg cartons will be moved by the upper flights into the storage zone and disposed in side-to-side abutting juxtaposition therein for respectively contacting and closing a like number of normally open switches, the circuit being made when all switches are closed so as to actuate a control which withdraws the slide plates, simultaneously from beneath the inner portions of the flights. At that time, all egg cartons, which are positioned in the storage zone, are lowered, simultaneously, onto the upstanding ends of the rods. The withdrawal of the slide plates actuates a mechanism which lowers the rods by a prescribed distance so as to position the first layer, which is supported by the rods, below the plane of the upper flights of the belts. Thereafter, the slide plates are moved in beneath the conveyor belts and a subsequent layer of cartons is accumulated so that the second layer of cartons is placed carton for carton stacked on the first layer, at which time the operation is repeated. When sufficient layers have been received one on top of the other to fill the container, the rods are withdrawn downwardly through the bottom of the container and the filled container is moved transversely by the container cross conveyor whereby a subsequent empty container is disposed in its place. When discharged from the loading zone, the filled container is received on a carriage which tilts by gravity to discharge the loaded crate from the machine. The operation is then repeated.

DETAILED DESCRIPTION

Figure 1:
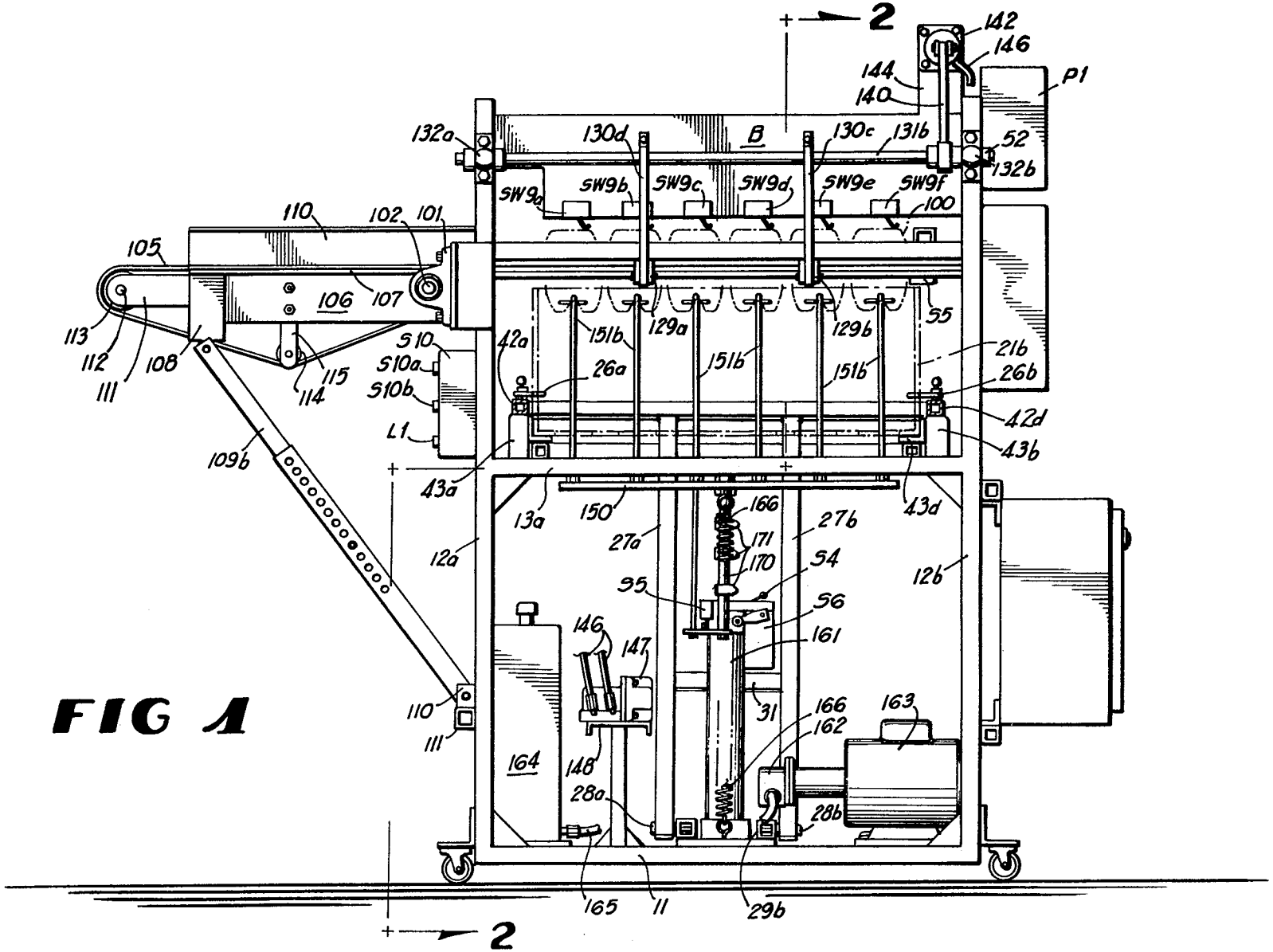
FIG. 1 is a side elevational view of an egg crate or container loading machine constructed in accordance with the present invention.

Referring now in detail to the embodiment chosen for the purpose of illustrating the present invention, numeral 10, in FIG. 1, denotes generally the body frame of the egg crate or container loading machine. This body frame 10 includes a rectangular bottom or base frame 11, the corners of which are provided with upstanding corner standards **12*a*, 12*b*, 12*c* and 12*d*. Central, horizontal, longitudinally disposed, cross bars 13*a* and 13*b* extend between intermediate portions of standards 12*a* and 12*b* and standards 12*c* and 12*d*. These spaced cross bars 13*a* and 13*b* are parallel to each other and disposed in a common transverse plane. The upper ends of the rear standards 12*b* and 12*d* are connected together by a cross bar 14, seen in FIG. 2. Extending parallel to the cross bar 14 but disposed therebelow is a second cross bar 15 which extends between the rear standards 12*b* and 12*c***.

Figure 2:
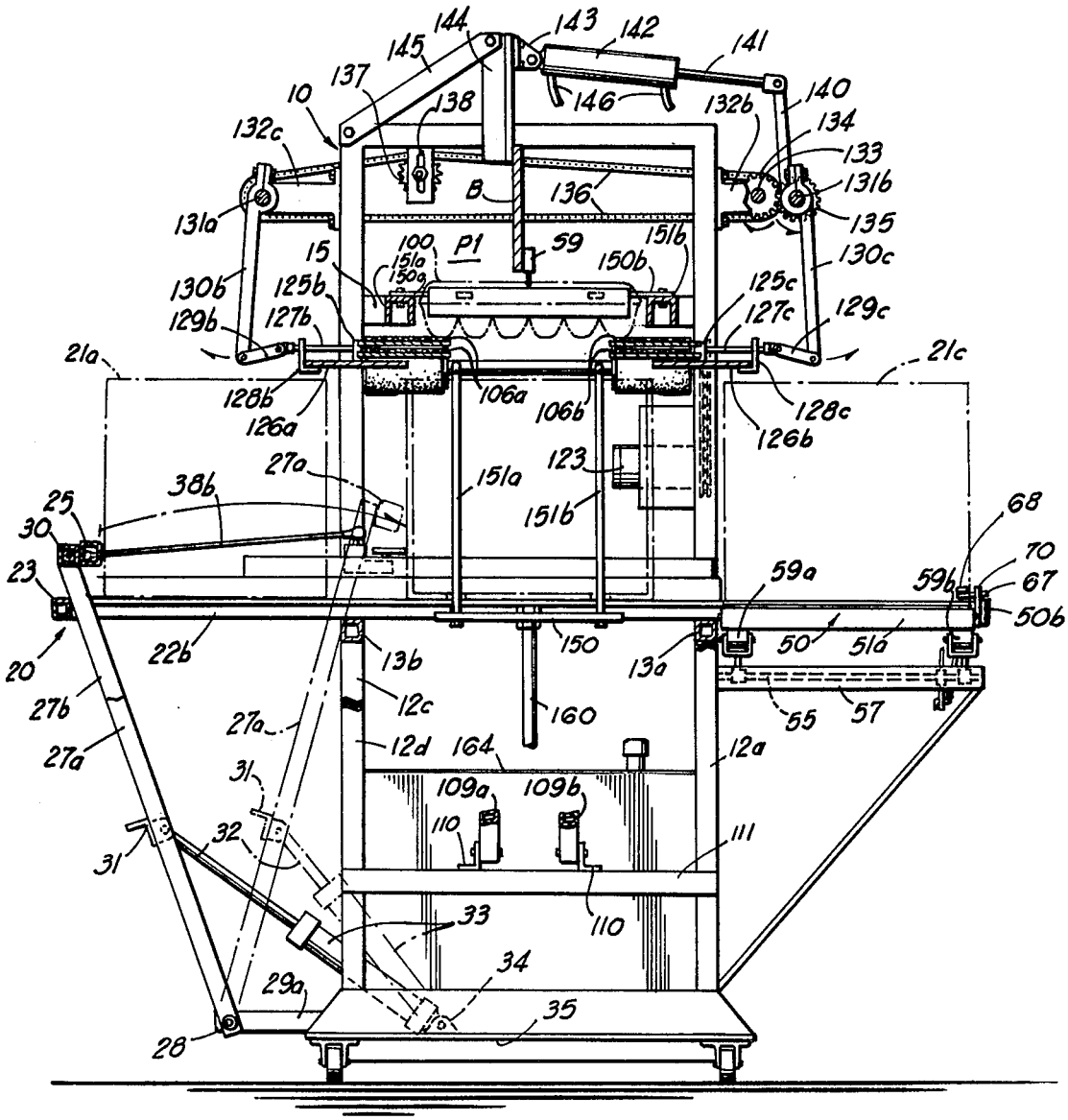
FIG. 2 is a vertical sectional view taken substantially along 2—2 in FIG. 1.
Figure 4:
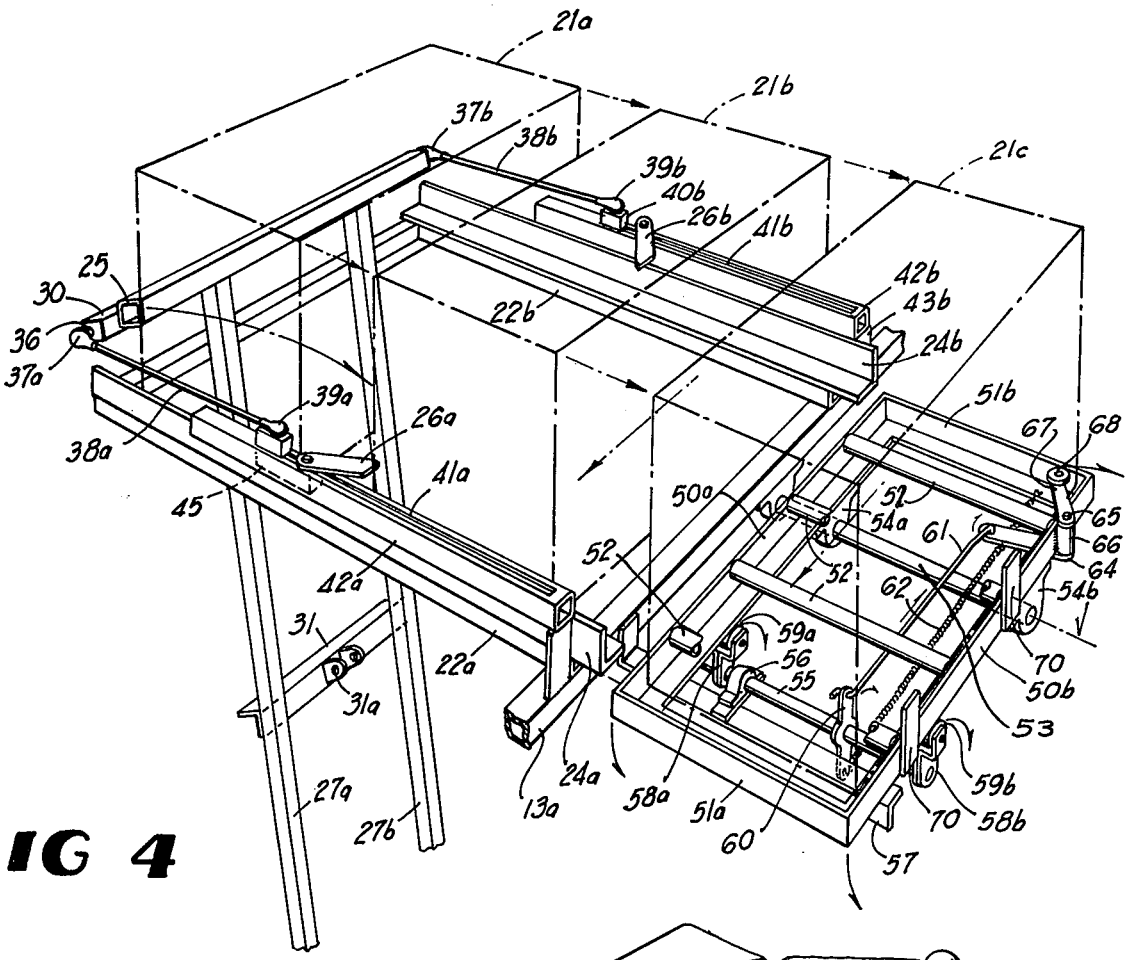
FIG. 4 is a fragmentary perspective view of the container cross conveyor of the machine depicted in FIG. 1, crates or containers thereon being shown in broken lines.
Figure 5:
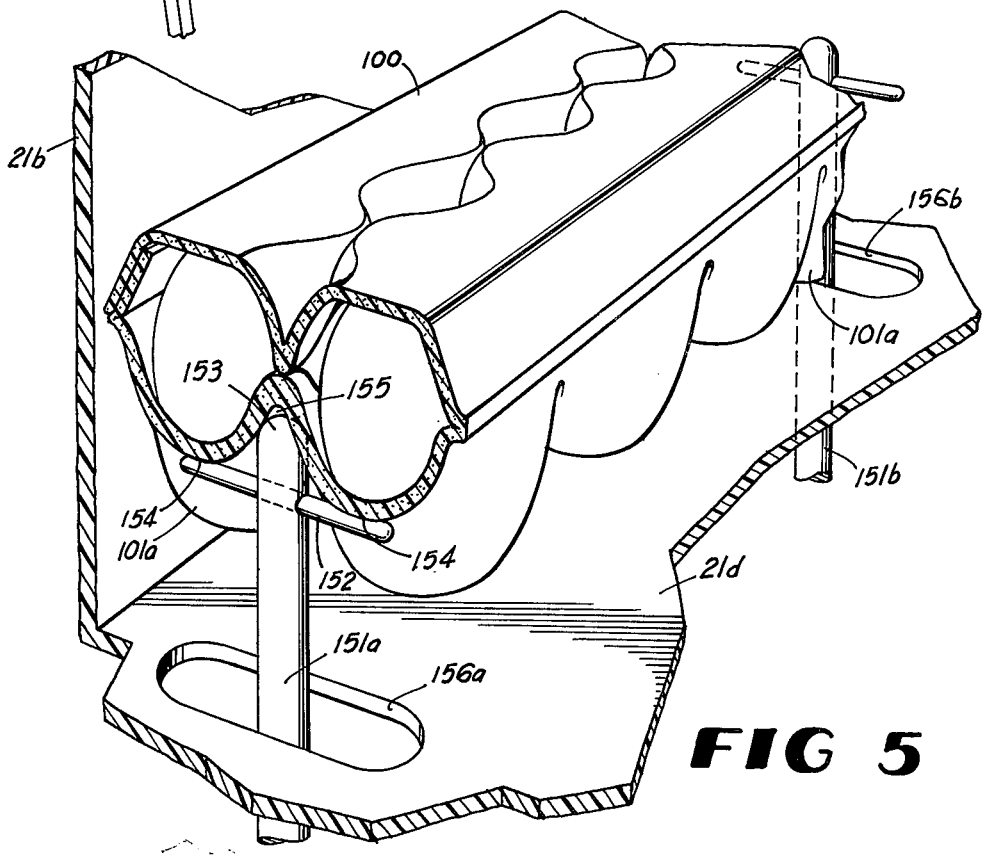
FIG. 5 is an enlarged fragmentary perspective view of a detail, depicting the upstanding bars or rods of the machine shown in FIG. 1 receiving a carton, within the crate or container.

As best seen in FIGS. 2 and 4, the frame 10 is provided, at its mid portion, with a crate or container cross conveyor, denoted generally by numeral 20. The purpose of this cross conveyor 20 is to convey receptacles, such as the crates or containers 21*a*, 21*b* and 21*c* successively and intermittently, in a transverse or lateral linear path through the machine from one side to the other. The empty receptacles, such as crate or container 21*a*, are successively placed by hand or conveyor (not shown) on the machine in the position depicted for container 21*a* and then each is fed to and stopped in a position of the container 21*b* and then to the position of container 21*c*. In the position of the container 21*b*, the container is filled by the machine and in the position of container 21*c*, the container is discharged in a filled condition from the machine.

In more detail, the container cross conveyor 20 includes a U shaped conveyor side frame supported by the cross bars 13*a* and 13*b*. This conveyor frame includes a pair of opposed, parallel, transversely extending struts 22*a* and 22*b*, joined at their infeed end by a cross strut 23. The discharge end of struts 22*a* and 22*b* terminate at the cross bar 13*a*.

Mounted on the struts 22*a* and 22*b* are a pair of opposed parallel, L-shaped, inwardly and upwardly opening, guide bars 24*a* and 24*b*, respectively. The function of these guide bars 24*a*, 24*b* is to receive the containers by their opposite bottom edge portions and permit them to slide, therealong.

The conveyor mechanism for the conveyor 20 include a longitudinally extending laterally reciprocatable push bar 25 and a pair of laterally reciprocatable, opposed, pawls or fingers 26*a* and 26*b* linked thereto, the push bar 25 serving to move the containers successively from the position of container 21*a* to the position of container 21*b* and the fingers 26*a* and 26*b* serving to move the containers successively from the position of container 21*b*to the position of container 21*c*.

The control mechanism for simultaneously actuating the push bar 25 and the fingers 26*a* and 26*b* includes an upstanding lever assembly provided with parallel, opposed, lever arms 27*a* and 27*b*. The lower ends of lever arms 27*a* and 27*b* are respectively pivotally mounted on the side of the machine by pivot pins 28*a* and 28*b* to transversely extending bars 29*a* and 29*b*, respectively. The upper ends of lever arms 27*a* and 27*b* project upwardly and outwardly from pins 28*a*, 28*b* and are connected by a longitudinally extending cros bar 30, to which is mounted the push bar 25.

Intermediate the ends of the lever arms 27*a* and 27*b* and parallel to cross bar 30 is a second cross bar 31, the central portion of which carries a pair of inwardly projecting brackets 31*a*, 31*b* to which is pivotally mounted the free end of piston rod 32 of a hydraulic cylinder 33. The other end of the cylinder 33 is pivotally mounted, by means of a pivot bracket 34, to the base plate 35, carried by the base frame 11. When the piston rod 32 is in an extended position, as shown in full lines in FIG. 2, the lever arms 27*a* and 27*b* rest upon the inner surface of cross strut 23, as depicted in FIG. 2, the cross strut 23 limiting further outward movement of the lever arms 27*a* and 27*b*. When the piston rod 32 is retracted, by cylinder 33, the lever arms 27*a*, 27*b* are pivoted in an arcuate path inwardly toward the machine until the lever arms 27*a*, 27*b* rest upon the cross bar 13*b*, as depicted by broken lines in FIG. 2. In the movement of the lever arms 27*a*, 27*b*, the container or crate, in the position of the container 21*a*, is moved to a position of the container or crate 21*b*.

As depicted best in FIGS. 2 and 4, the end portions of cross bar 30 extend outwardly of the lever arms 27*a*, 27*b* and also outwardly of the ends of the push bar 25. Thus, the ends of cross bar 30 terminate outwardly of the guide bars 24*a*, 24*b* and are provided with axially extending pivot pins, such as pin 36, seen in FIG. 4. The pins, such as pin 36, are respectively provided with pivotally mounted outer caps 37*a*, 37*b*. These caps 37*a* and 37*b* are respectively secured to push rods 38*a* and 38*b* which extend inwardly, approximately parallel to each other, the inner ends of the push rods 38*a*, 38*b* being respectively provided with inner caps 39*a*, 39*b*. The inner caps 39*a*, 39*b* respectively receive pivot pins (not shown) disposed on the ends of slide bars 40*a*, 40*b*.

Other pins (not shown) project through slots 41*a*, 41*b* in the spaced, parallel, transversely extending, tubular, slide housings 42*a*, 42*b*, these slide housings being mounted by brackets, such as brackets 43*a*, 43*b*, and 43*d* on the machine. The inner brackets 43*a*, 43*b* are secured to bar 13*a* while the outer brackets 43*c* and 43*d* are mounted on the outer surface of the guide members 24*a*, 24*b*. Thus, the tubular member 42*a* and 42*b* are held rigidly in alignment with their respective guide bars 24*a*, 24*b*. Within the tubular members 42*a*, 42*b* are, respectively, slide blocks, such as slide block 45, which connect the block 40*a* to the finger 26*a*. The finger 26*a* is pivotally carried by the block 45 and is spring urged to the position depicted in FIG. 4 but will yieldably pivot to a position in alignment with its tubular member 42*a*.

It is, therefore, seen that the fingers 26*a*, 26*b* are linked to and moved simultaneously with the movement of bar 25. The function of these fingers 25*a*, 25*b* is to push against the opposed outer rearcorner surfaces of the container, in the position of receptacle of 21*b*, so as to urge it to the position of container 21*c*, as the bar 25 urges the container, in the position of container 21*a*, to the position of container 21*b*. Upon the return of the fingers 26*a*, 26*b*, these fingers will pivot outwardly so as to ride along the opposite sides of the container 21*b* until they clear that container and again spring toward each other into the positions shown in FIG. 4.

Disposed outwardly of the bar 13*a* is a tiltable container discharge conveyor which comprises a tiltable frame carriage 50 having longitudinally disposed spaced parallel side members 50*a* and 50*b* and transversely disposed end members 51*a* and 51*b* which join the ends of the side members 50*a* and 50*b* to form a rectangular open frame carriage 50, best seen in FIG. 4. Extending across the frame carriage 50, in a common plane and at regularly spaced intervals, are a plurality of parallel disposed rollers 52, each roller being supported for rotation about a transverse axis by the side members 50*a*, 50*b*. These rollers 52 form a short roller conveyor section, down which the receptacle 21*c* will move by gravity. It will be understood, however, that the frame carriage 50 is normally disposed in a horizontal position, as depicted in FIG. 4.

Supporting the frame carriage 50, for pivotal movement by gravity about a transverse axis, is a pivot shaft 53 projecting sidewise from the bar 13*a*, the shaft 53 receiving, for pivotal movement, the downwardly projecting pillow blocks 54*a*, 54*b* adjacent the end portions on members 50*a*, 50*b*, respectively. Pivot shaft 53 is forward of the center of gravity of the carriage 50. Disposed parallel to the shaft 53 beneath the frame carriage 50 is a second shaft 55 which is journalled by pillow blocks, such as pillow block 56, for rotation about a transverse axis. The pillow blocks, such as pillow block 56, are carried by a transversely outwardly extending bracket 57 which protrudes from and below the bar 13*a*. A pair of upstanding lever arms 58*a*, 58*b* are respectively secured to the ends of the shaft 55, outwardly of the pillow blocks, such as pillow block 56. The ends of these lever arms 58*a*, 58*b* carry freely rotatable rollers 59*a*, 59*b*. Rollers 59*a*, 59*b* are disposed beneath the side members 50*a*, 50*b* respectively and, therefore, when the lever arms 58*a*, 58*b* extend in an upright position these rollers 59*a*, 59*b* support the frame carriage 50 which includes the side members 50*a*, 50*b* in a horizontal position disposed slightly below the discharge ends of the guide members 24*a*, 24*b*.

For rotating the shafts 55*a* about its axis so as to move the rollers 59*a*, 59*b* in arcuate paths, as indicated by the arrows in FIG. 4, a control arm 60 is fixedly secured to the shaft 55. One end of the control arm 60 protrudes upwardly and the other end protrudes downwardly from shaft 55, the upper end being provided with a pivotally connected rigid control rod 61 and the lower end being provided with a coiled spring 62. The rigid rod 61 extend forwardly and is connected to the upper portion of a control arm 64 of an offset bell crank. This bell crank includes a vertical shaft 65 journalled by a journal 66 on side member 50*b*. The upper end of the shaft 65 is provided with a crank arm 67 having a roller 68 carried thereby. Spring 62 connected between the lower portion of arm 64 and member 51*b* urges arm 60 in a counterclockwise direction as viewed in FIG. 4.

When the carton 21*c* is discharged from the guide member 24*a*, 24*b* onto the rollers 52, the roller 68 is pivoted outwardly, in the direction of the arrow seen in FIG. 4, so as to move the rigid rod 61 forwardly and cause the shaft 55 to be rotated so as to move the rollers 59*a*, 59*b* in arcuate paths downwardly, thereby permitting the tilting of the frame carriage 50 which includes the members 50*a*, 50*b* so that the carton 21*c* may roll by gravity off of the rollers 52. Upstanding stops 70, on the outer side of carriage 50 on member 50*b*, arrest outward movement of the container 21*c*.

A suitable off loading conveyor (not shown) is disposed adjacent the discharge end of the frame carriage 50 so as to convey each carton, discharged, away from the machine. This off loading conveyor is not illustrated since it is entirely conventional.

Once the container or receptacle 21*c* has been discharged from the tiltable container discharge conveyor carriage 50 is sufficiently light that the spring 62 will urge lever 60 back to its original upright position, as shown in FIG. 4, and thereby cause the rollers 59*a*, 59*b* to return the frame carriage 50 to its original horizontal position.

Figure 3:
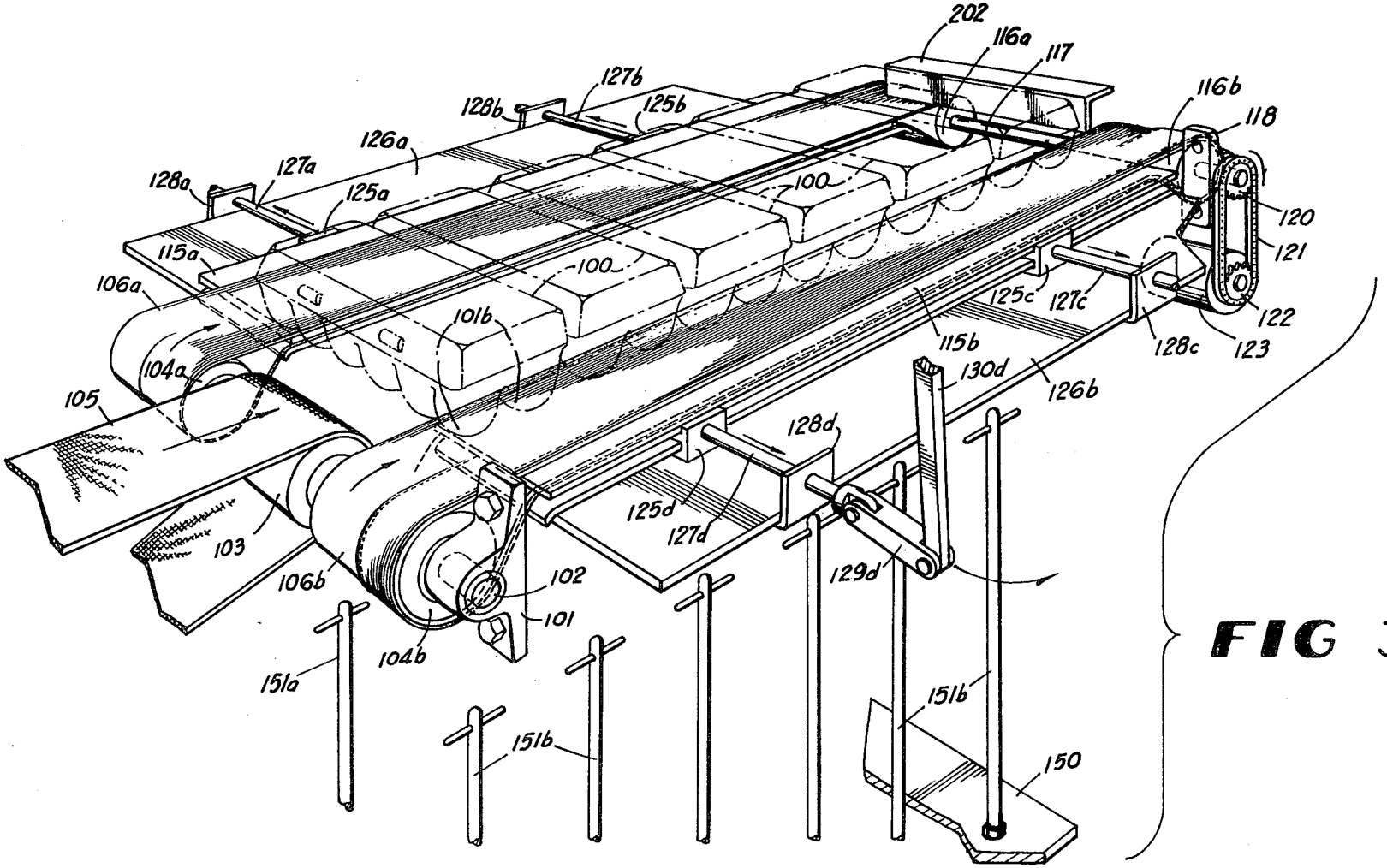
FIG. 3 is a perspective view of a portion of the machine depicted in FIGS. 1 and 2 showing primarily the carton storage zone, certain parts of the machine being deleted for clarity.

Referring now to the egg carton or article infeed mechanism by which the individual egg cartons 100 are fed to the machine, the standards 12*a* and 12*b* are respectively provided with transversely opposed blocks, such as pillow block 101, which carry transverse shaft 102 of the infeed conveyor, as illustrated in FIGS. 1 and 3. This common shaft 102 carries a central roller 103 and a pair of outer rollers 104*a* and 104*b*, the outer rollers 104*a*, 104*b* being of larger diameter than the central roller 103. Hence, the belt 105, passing over roller 103, is driven at a lower linear speed than the speed of the two infeed belts 106*a* and 106*b*, passing around rollers 104*a*, 104*b*. In this way, the cartons 100 will be separated sufficiently that, when the appropriate number of cartons 100 are collected in the storage zone, and the drive of the belts 106*a*, 106*b* is interrupted, no additional cartons 100 will be fed to the storage zone.

Journalling the shaft 102, between the pillow blocks, such as pillow block 101, and the roller 104*a* and 104*b*, are a pair of spaced upstanding plates, such as plate 106, seen in FIG. 1. The upper edges of these two vertically disposed side plates carry a horizontally disposed bed plate 107 thereon, the bed plate 107 passing beneath the upper flight of a continuous infeed conveyor belt 105. Connected to the outer ends of the bed plate 107 are a pair of spaced downwardly protruding supports, such as support 108. Each support 108 is provided with an extensible brace 109 the effective length of which can be varied, as desired. The brace 109 is connected pivotally to the bottom portion of the support 108 and also pivotally to a bracket 110 on a cross bar 111 which extends between the standards 12*a* and 12*d*. Thus, the angular position of the bed plate 107 can be adjusted about the shaft 102, so that, selectively, the belt 105 can be inclined upwardly or downwardly or disposed in a horizontal plane.

On opposite side edges of the upper flight of continuous belt 105, the bed plate 107 is provided with upstanding spaced parallel guard rails, such as rail 110, each guard rail being a channel shaped member as depicted in FIG. 1. Protruding outwardly, ie. forwardly, from the supports, such as support 108, are a pair of brackets, such as bracket 111, the front ends of which carry, therebetween, a transverse shaft 112 on which is mounted for rotation a roller 113. The upper flight of belt 105 passes over the roller 113, bed plate 107 and around the bottom flight passing over an idler roller 114, seen in FIG. 1. This idler roller 114 is carried between downwardly protruding brackets, such as bracket 115, carried by the plate 106.

Egg carton 100, which are fed to the machine, are carried sidewise, in succession, along the upper flight of belt 105 inwardly or rearwardly, and thence are transferred successively to belts 106*a*, 106*b* and then carried by their bottom end portions resting on the opposed inner portions of the upper flights of these spaced, opposed, continuous belts 106*a* and 106*b*, each egg carton 100 being disposed transversely and being moved inwardly as far as it will go into the accumulation or storage zone, as depicted in FIG. 3. The upper flight of the belts 106*a* and 106*b* ride respectively upon opposed, rectangular, rigid, flat metal slide plates 115*a* and 115*b*. The forwardmost ends of the belts 106*a* and 106*b* pass around roller 104*a* and 104*b*, respectively, and the rearmost portions pass around rollers 116*a* and 116*b*, respectively. These rollers, 116*a*, 116*b*, in turn are carried on a common transverse shaft 117 which is journalled for rotation by pillow blocks, such as pillow block 118, disposed outwardly of the rollers 116*a*, 116*b*. Pillow blocks, such as pillow block 118, are mounted to the standards 12*b* and 12*c*, respectively, so as to support the upper flight of the belts 106*a* and 106*b* in a horizontal plane.

Outwardly of the pillow block 118, the shaft 117 is provided with a sprocket 120 which is driven by a continuous chain 121 from a sprocket 122 on an hydraulic motor 123. Thus, the motor 123 drives the belt 106*a* and 106*b* which in turn drive the shaft 102 to drive the belt 105.

The lower flights of the belts 106*a*, 106*b* pass closely adjacent to and below the lower surface of the slide plates 115*a*, 115*b*, the lower flights being supported on opposed slide plates 115*c* and 115*d*. Thus, the slide plates 115*a* and 115*c* sandwich the lower flight of belt 106*a* and the slide plates 115*b* and 115*d* sandwich the lower flight of belt 106*b*.

Opposed longitudinally extending end guides 150*a*, 150*b*, carried by channel members 151*a*, 151*b* supported by cross bars, such as cross bar 15, maintain the ends of cartons 100 in alignment in the storage zone.

Outwardly of the belts 106*a*, 106*b*, the edges of slide plates or trays 115*a* and 115*c* are connected together in spaced relationship to each other by slide blocks 125*a*, 125*b*, 125*c* and 125*d*. These slide blocks ride upon opposed coplanar flat horizontal shelves 126*a* and 126*b* carried by standards 12*a*, 12*b*, 12*c*, 12*d*. The slide blocks 125*a*, 125*b*, 125*c* and 125*d* are respectively provided with outwardly protruding control rods 127*a*, 127*b*, 127*c* and 127*d*. The rods respectively pass through upstanding brackets 128*a*, 128*c* and 128*d* at the outer edges of shelves 126*a*, 126*b*. Links, such as links 129*b*, 129*c*, 129*d* respectively, pivotally connect the outer ends of the rods 127*a*, 127*b*, 127*c*, 127*d* to upstanding control arms, such as arms 130*b*, 130*c*, 130*d*. The upper ends of control arms, such as control arm 130*b*, are connected to and rotate with the longitudinally extending control shaft 131*a*. In like fashion, the upper ends of the control arms 130*c* and 130*d* are connected to a control shaft 131*b*. The control shafts 131*a* and 131*b* are disposed on opposite sides of the frame 10, the shafts 131*a*, 131*b* extending longitudinally parallel to each other. Brackets 131*a* and 131*b* which project sidewise from the upstanding standards 12*a* and 12*b* support the shaft 131*b* for a rotation, while brackets, such as bracket 132*c* an standard 12*c*, support shaft 131*a* for a rotation.

Inwardly of the shaft 131*b* and disposed parallel thereto is a second shaft 133 which projects through and is journalled by the bracket 132*b*. The shaft 133 is provided with a cogwheel 134 which meshes with a cogwheel 135 on shaft 131*b*. Outwardly of the cogwheel 134, the shaft 133 is provided with a sprocket (not shown) which receives an endless chain 136, the endless chain 136 extending across the machine and around a sprocket (not shown) on shaft 131*a*. A take-up or idler sprocket 137 carried by a bracket 138 on cross bar 14 carries the idler sprocket 137 so that it may be adjusted to tighten or loosen the chain 136.

An upstanding control lever 140 is mounted on the end of shaft 131*b* and is connected through a pivotal link to a piston rod 141 carried by a doubling acting hydraulic cylinder 142. The hydraulic cylinder 142, in turn, is pivotally mounted to an upstanding bracket 144 which extends up from the cross bar 14. The bracket is braced by brace 145. Hydraulic lines 146 supply fluid to the double acting cylinder 142 via solenoid valves V3 and V4 in hydraulic line 146 so as to retract and extend the piston 141 to control the slide plates 115*a*, 115*b*, 115*c* and 115*d*. When the piston rod 141 is extended, lever 140 pivots shaft 131*b* in a clockwise direction in FIG. 2 so as to move the control arms 130*b* and 130*c*, inwardly. The sprockets 134 and 135, however, rotate the shaft 133 in a counter-clockwise direction so as to drive the chain 136 for rotating the shaft 131*a* in a counter-clockwise direction. Thus, all control arms, such as control arms 130*b*, 130*c* and 130*d* are moved inwardly to urge the slide plates 115*a*, 115*b*, 115*c* and 115 *d* towards each other so that they provide support for the flights of the belts 106*a* and 106*b* and thereby support any of the cartons 100 which are moved inwardly into the storage zone by the belts 106*a* and 106*b*.

When, however, the piston rod 141 is retracted, the slide plates are moved away from each other so as to release the crates 100 so that they fall by gravity downwardly into the accumulation zone therebelow.

For receiving the cartons 100 and for stacking the same as illustrated in FIGS. 6, 7, 8 and 9, the accumulation zone is provided with a flat rectangular platform 150 which is moved upwardly and downwardly, toward and away from the storage zone. This platform 150 is provided with upstanding rods 151*a* and 151*b*. The rods 151*a* and 151*b* are in spaced parallel relationship to each other and are aligned both longitudinally and transversely, each rod being an upstanding straight rigid member, the lower portion of which is of reduced diameter, projecting through holes in the platform 150. Nuts secure the rods in place. The upper end of each rod 151*a*, 151*b* is rounded at numeral 153 and, downwardly therefrom, is provided with a transverse hole through which a transverse carton receiving rod 152 extends.

Each of the rods 151*a*, 151*b* terminates in a common horizontal or transverse plane. Each of the transverse rods 152 projects radially in opposite directions form its rod 151*a* or 151*b*, all such rods 152 terminating in a horizontal or transverse plane spaced below the plane of the upper ends 153 of the rods 151*a*, 151*b*.

Each pair of transversely opposed rods 151*a*, 151*b* is adapted to receive an egg carton 100. The spacing between each pair of transversely opposed rods 151*a* and 151*b*, is, however, less than the length of a carton 100 and approximately equal to the distance between four of the aligned cells 101*a* of the carton 100. Therefore, the spacing between the upper ends 153 of a pair of rods 151*a*, 151*b* is such that, as one end 153 is received in a central bottom recess 155 defined by the outer four cells 101*a* of the bottom portion of the carton 100, the end 153 of its transversely opposed rod 151*b* will be received in a similar central recess (such as recess 155) defined by the outer four cells 101*a* at the other end of the carton 100. Also, the distance from the end 153, to the upper surface of the transverse rod 152, is approximately equal to or less than the distance between the upper end of the central recess 155 and the front and back valleys 154 which are between the outer cells 101*a* and the next adjacent pair of cells 101*a*. Therefore, the carton 100 is firmly retained, with its spaced valleys 154 resting upon the upper surfaces of the rod 152, as the upper end 153 projects into the central recess 155. Hence, the carton 100 can not readily be moved either transversely or longitudinally. Furthermore, there is essentially no tendency of the carton 100 to tilt in any direction and the upper surface of such carton is disposed in a horizontal plane to receive a stack of cartons 100 thereon.

The containers, such as container 21*b*, are specifically designed so that the bottom of each container 21*b* has a plurality of evenly spaced longitudinally elongated and aligned openings 156*a* inwardly adjacent one side and a second corresponding group of longitudinally aligned openings 156*b*. Each opening 156*a* is transversely opposed to an opening 156*b*, the spacing between their centers being equal to the spacing of the centers of opposed rods 151*a*, 151*b*. The length of the elongated openings 156*a* and 156*b* in a longitudinal direction of the machine is greater than the length of transverse rod 152 and hence the upper end portion of each of the rods 151*a*, 151*b* can readily pass upwardly through these openings 156*a*, 156*b* and be moved downwardly, therethrough.

The rods 151*a*, 151*b* are of a length greater than the height of the container 21*b*. Also, the distance of travel of the platform 150 is greater than the height of container 21*b*.

The central portion of the platform 150 is supported by the upper end of an upstanding piston rod 160, the lower end portion of which is carried in a double acting hydraulic cylinder 161. This upright hydraulic cylinder 161 is mounted on a base 174 carried by bottom frame 11 and is controlled by solenoid valves V5 and V6, the valve V5, when open, dictating that the platform move downwardly and the valve V6, when open, dictating that the platform move upwardly. Each of these valves V5, V6 is a solenoid valve and is controlled by the electrical circuitry to be described, hereinafter.

A hydraulic pump 162, driven by an electrical motor 163, supplies hydraulic fluid from the low pressure side of an accumulator tank 164 to the high pressure side thereof by hydraulic line 165.

The accumulator tank 164 is connected to the single acting container transfer cylinder 33, through solenoid valve V1 which, when opened, will actuate the hydraulic cylinder 33 to retract its piston 32. The accumulator tank 164 is also connected to the motor 123 through a valve V2 and when the valve V2 is opened, the hydraulic fluid under pressure will drive the motor 123. All of the solenoid valves, such as valve V3, are supported on a platform 148 supported by an upstanding bracket 147.

Extending downwardly from the platform 150 is a lug supporting rod 170 provided with a plurality of vertically spaced lugs 171. A platform down travel control switch S6 is supported on the upper end portion of the cylinder 161 so as to be successively engaged by anyone of the lugs 171. A switch S4 is mounted on the top of the switch S6 and functions as a lower limit switch to be engaged by the platform 150 when it has reached the bottommost portion of its travel.

Upper limit switch S3 is also disposed on the upper end portion of the cylinder and is adapted to be engaged by upper surface of a horizontal plate 172, supported on the lower end of rod 170 and by a secondary rod 173. The plate 172 engages switch S3 when the platform 150 has reached the uppermost portion of its travel.

A coiled spring 166 is provided between the base 174 of cylinder 161 and the platform 150 so as to maintain the platform against inadvertent oscillations.

In FIG. 1, the notation P1 denotes a chain cover, for the chain 136. The notations P2 and P3 denote the electrical panels which contain the electrical circuitry to be described hereinafter.

ELECTRICAL SYSTEM

Figure 10A:
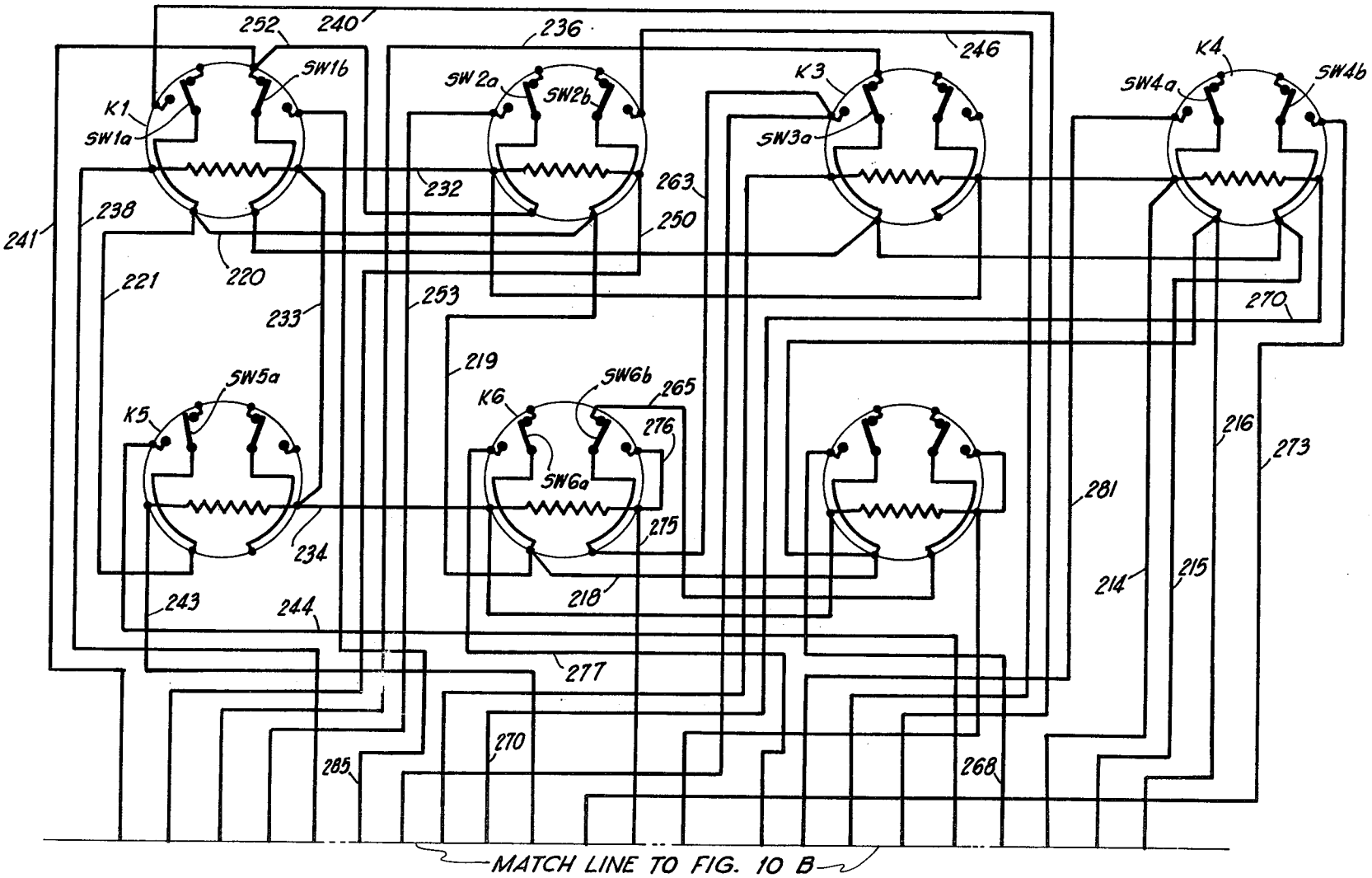
FIGS. 10A, 10B and 10C are schematic diagrams of the electrical circuitry of the machine depicted in FIG. 1.
Figure 10B:
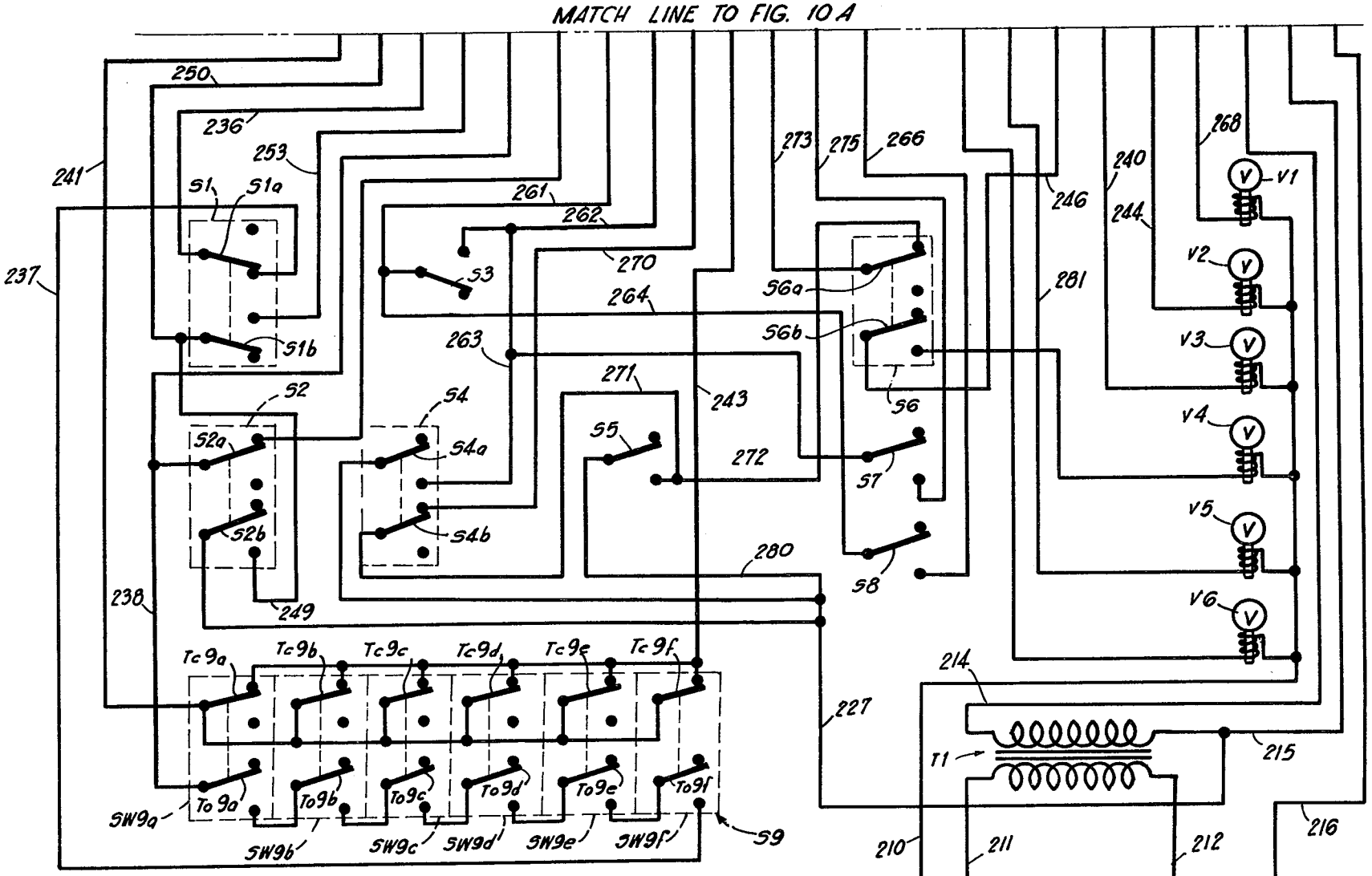
Figure 10C:
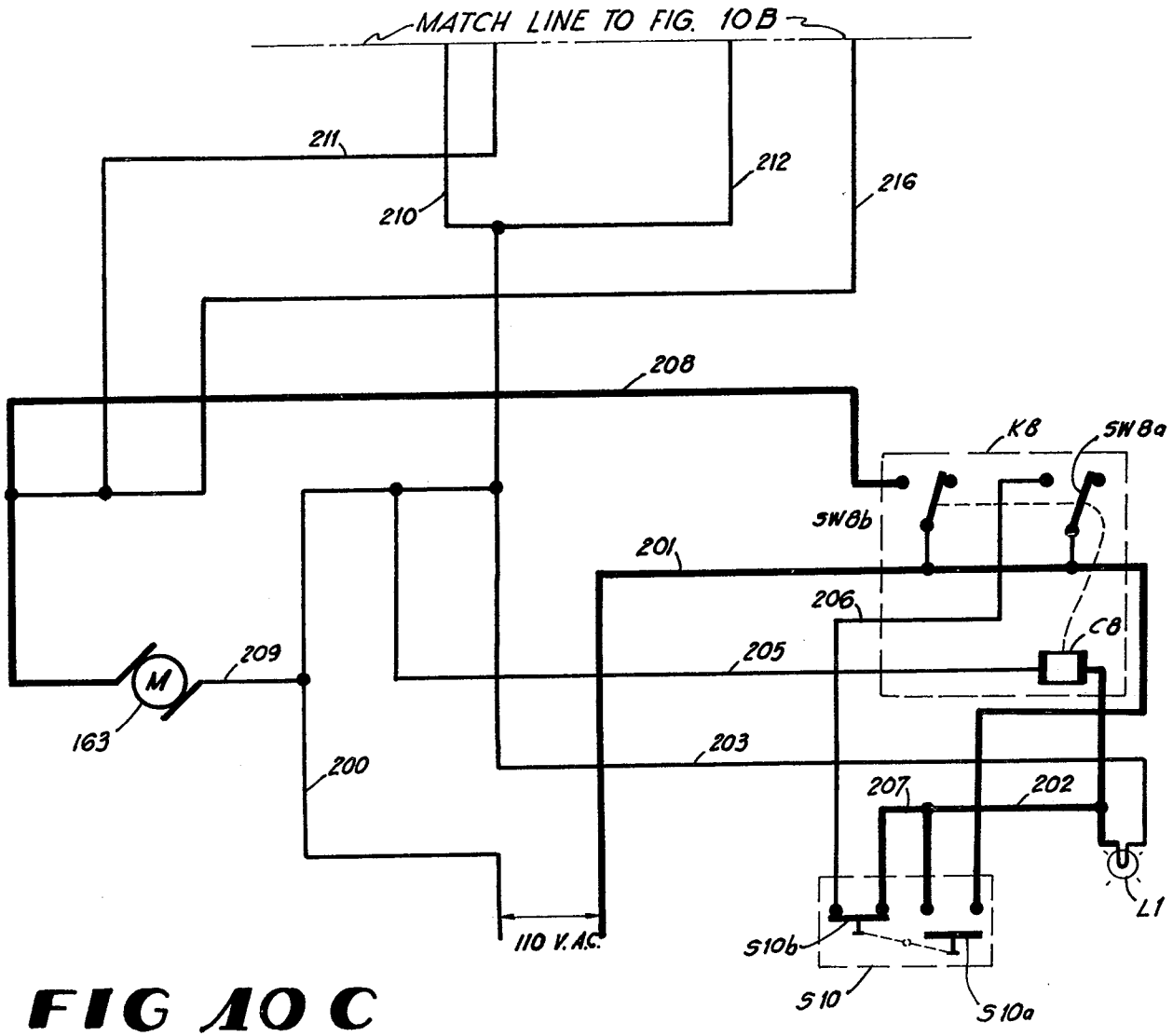

In Table I is a listing of the functions of the various components, found in FIGS. 10A, 10B and 10C, of the electrical system of the present invention.

TABLE I

SWITCHES

| | |
|---|---|
| S-1 | Tray or Slide Plate Opened Switch |
| S-2 | Tray or Slide Plate Closed Switch |
| S-3 | Platform at Top Switch |
| S-4 | Platform at Bottom Switch |
| S-5 | Platform Down Switch - Detects Egg Cartons |
| S-6 | Platform Positioning Switch |
| S-7 | Empty Crate in Position Switch |
| S-8 | Empty Crate Injector Switch |
| S-9 | Cartons in Position Switch (6 switches) |
| S-10 | Main Power On-Off Switch |

RELAYS

| | |
|---|---|
| K-1 | Tray Open Relay |
| K-2 | Tray Close Relay |
| K-3 | Platform at Top or Bottom Relay |
| K-4 | Platform Lowering Relay |
| K-5 | Conveyor Control Relay |
| K-6 | Platform Up Relay |
| K-7 | Crate Injector Relay |
| K-8 | Main Power Relay |

MOTOR

| | |
|---|---|
| 163 | Hydraulic Pump Motor |
| 123 | Carton Conveyor Motor |

TRANSFORMER

| | |
|---|---|
| T-1 | Low Voltage Transformer |

LAMP

| | |
|---|---|
| L-1 | Pilot Lamp |

SOLENOID VALVES

| | |
|---|---|
| V-1 | Crate or Container Insertion into Receiving Position |
| V-2 | Hydraulic Motor for Conveyor |
| V-3 | Tray or Slide Plate Open |
| V-4 | Tray or Slide Plate Close |
| V-5 | Platform Down |
| V-6 | Platform Up |

In more detail, 110 volts a.c. is supplied to the system via ground wires 200 and hot wire 201, in FIG. 10C. The hote wire 201 leads to the normally open "on" switch S10*a* of the main power on-off switch S10. Switch S10*a* is momentarily manually closed to energize the machine, thereby supplying current via wire 202 to light the pilot lamp L1. Lamp L1 is grounded by wire 203 to ground wire 200.

Current is also supplied, via wire 204 through coil C8 of relay K8 and wire 205 to ground wire 200. The energizing of coil C8 closes the normally open switches Sw8*a* and Sw8*b* of relay K8. Switch Sw8*a* is in series in a hold down circuit with the normally closed "off" switch S10*b* of switch S10, the circuit leading from hot wire 201 via switch Sw8*a*, wire 206, switch S10*b* and wire 207 to wire 202. Hence, current continues to be supplied to energize coil C8 until switch S10*b* is manually opened.

Switch Sw8*b* of the main power relay K8 is also closed by the energizing of coil C8; the switch Sw8*b* thus supplied current from hot wire 201 high voltage bus 208 so as to energize the hydraulic pump motor 163, the motor being connected via wire 209 to ground wire 200.

Wire 211 connects one side of the primary winding of transformer T1 to bus 210, the other side of which is connected via wire 212 to ground wire 200. The secondary winding of transformer T1 supplies 24V a.c. current via common wire 214 and hot wire 215 to the components of FIG. 10A. High voltage is supplied to the components of FIG. 10A from bus 210 via buses 216, 217, 218, 219, 220 and 221.

Ground wire 200 is also connected via wire 210 to one side of all solenoid valves V1, V2, V3, V4, V5 and V6. Each valve is opened when energized.

The relays K1, K2, K3, K4, K5, K6 and K7 are each plug-in type relays having eight pins. Pins 2 and 7 are the leads of the coil or windings and pin 1 leads to one of the double pole double throw switches, the selective contacts of which connect to pins 3 and 4. Pin 8 leads to the other double throw switch, the selective contacts being connected to pins 5 and 6.

The low voltage hot wire 215 is connected to switch Sw4*b*, then via wire 225 to switch Sw3*a*, then via wire 226 to switch Sw1*b*.

In FIG. 10*b* the low voltage hot wire 215 is connected via hot wire 227 to normally open platform down switch S5. Also current is supplied from hote wire 227, via hot wire 228 to normally open switch Sw2*b* of tray closed switch S2 while current is supplied via hot wire 229 to normally open switch Sw4*a* of the lower limit switch S4.

It will be remembered that tray open switch S1 indicates when the tray is open i.e., when the slide plates 115*a*, 115*b*, 115*c*, 115*d* are retracted fully and that tray closed switch S2 indicates when the slide plates 115*a*, 115*b*, 115*c*, 115*d* are closed fully. These two switches S1 and S2 can be mounted to be appropriately engaged by any of the moving parts of the slide plate assembly. For example, switches S1 and S2 are mounted on bracket 132 in a manner such as switch S2 in FIG. 1, to be selectively engaged by a lug (not shown) on chain 136 as the chain approaches its extreme travel in one direction or the other.

It will also be remembered that switch assembly denoted generally by notation S9 is mounted on a bracket B so as to dispose the individual switches Sw9*a*, Sw9*b*, Sw9*c*, Sw9*d*, Sw9*e*, Sw9*f* in spaced relationship to each other so that when the storage zone receives a carton, it will depress a corresponding individual switch. Thus, when six side-by-side cartons 100 are received, six, i.e. all switches Sw9*a*, Sw9*b*, Sw9*c*, Sw9*d*, Sw9*e* and Sw9*f* are depressed.

Each of the switches Sw9*a*, Sw9*b*, Sw9*c*, Sw9*d*, Sw9*e*, Sw9*f* has two throw arms, the normally closed throw arms being in parallel with each other and designated by Tc9 notations, namely Tc9*a*, Tc9*b*, Tc9*c*, Tc9*d*, Tc9*e* and Tc9*f*, and the normally open switches being in series with each other and designated by To9 notations, namely To9*a*, To9*b*, To9*c*, To9*d*, To9*e*, To9*f*.

Switch S3 is a top limit switch and switch S4 is a bottom limit switch mounted adjacent to the travel of platform 150 to be engaged selectively by the platform to indicate that the platform 150 is in its uppermost or lowermost position.

Switch S5 is a switch which indicates that the platform 150 is to move down. Switch S6, as previously pointed out, is in a position to be successively depressed by the lugs 171 to control the one layer increment movement of the platform 150.

Switch S7 is disposed in a position to detect the presence of a crate or container in the position of container 21*a* while switch S8 is in a position to detect a crate or container in the position of container 21*b*.

One side of all coils of the relays K1, K2, K3, K4, K5, K6 and K7 are connected to the common wire 214, via wires 230, 231, 232, 233, 234, 235.

With current supplied to pin 1 of relay K3, current is supplied via normally closed switch Sw3*a* and wire 236, through the normally closed switch S1*a* of switch S1, via wire 237 in FIG. 10B to the terminal of switch To9*f*.

If the slide plates 115*a*, 115*b*, 115*c*, 115*d* are closed fully, the storage zone can then receive egg cartons 100. This condition is indicated by switch S2 being depressed, thereby closing switch S2*b* and opening switch S2*a*. The closing of switch S2*b* completes a circuit from one side of the coil of relay K2 from hot wire 215, via wires 250, 249 and 228. This energizes the coil of relay K2, closing switches Sw2*a* and Sw2*b*. Switch Sw2*a* makes a circuit via from switch Sw1*b* via wires 252 and 253 so as to program switch S1*b* to wire 250 for holding in the coil of relay K2 after switch S1 is depressed.

The closing of switch Sw2*b* supplies high voltage via wire 246 to make hot switch S6*b* of switch S6. The closing of switch S6 therefore energizes valve V4.

The function of switch S6 is to determine if the platform 150 has lowered sufficiently for the plates 115*a*, 115*b*, 115*c*, 115*d* to clear the top of cartons 100. Thus, when a lug 146 depresses the switch S6 after lowering, valve V4 is in the hydraulic line and when energized, opens to cause double acting cylinder 142 to extend rod 141 and close plates 115*a*, 15*b*, 115*c*, 115*d* toward each other.

Switch Sw1*b* in its normal position supplies current from wire 226, via wire 241 and the normally closed switches Tc9*a*, Tc9*b*, Tc9*c*, Tc9*d*, Tc9*e*, Tc9*f* to wire 243 to energize the coil of relay K5, closing switch Sw5*a* to supply high voltage from wire 221, via wire 244 to energize solenoid valve V2.

Valve V2 permits hydraulic fluid from accumulator tank 164 to drive motor 123 and cause the belts 105, 106*a* and 106*b* to feed cartons 100 to the storage zone, until all switches Sw9*a*, Sw9*b*, Sw9*c*, Sw9*d*, Sw9*e*, Sw9*f* have been depressed by respective egg cartons 100. The depression of all the switches Sw9 open the Tc9 switches and closes the To9 switches. Hence, when all To9 switches are closed to indicate a full loading of cartons 100 in the storage zone, current is then supplied, via wire 238 to energize the coil of relay K1 thus throwing both its switches Sw1*a* and Sw1*b*.

Switch Sw1*a* supplies high voltage via wire 240 to solenoid valve V3. Valve V3 is in the hydraulic line 146 and permits cylinder 142 to retract piston rod 141 to open the slide plates 115*a*, 115*b*, 115*c*, 115*d*.

At the same time, however, the circuit to valve V2 is broken by either the opening of the Tc switches or the throwing of switch Sw1*b*, thereby stopping motor 123 and hence stopping conveyor 105, 106*a*, and 106*b*. Thus, no additional egg cartons 100 are fed to the storage zone.

When the slide plates 115*a*, 115*b*, 115*c*, 115*d* are fully opened, switch S1 is thereby automatically depressed, opening switch S1*a*. Hence, after the platform has lowered, the plates 115*a*, 115*b*, 115*c*, 115*d* are closed as described above so as to again program the machine to receive cartons 100 by opening valve V2 so that motor 123 again begins to drive the belts. This is accomplished since switch Tc9*a*, Tc9*b*, Tc9*c*, Tc9*d*, Tc9*e* and Tc9*f* are now closed, switch S2 is depressed and switch S1 is released, causing tray open relay K1 to be deenergized, and tray closed relays K2 and platform at top or bottom K3 to be energized.

If the platform is at the bottom of its travel, it depresses switch S4, closing the same to make a circuit via wires 229, through switch S4*a*, wires 263 and 262 to energize the coil of relay K3. This throws switch Sw3*a* so as to supply current to wires 261 and 263 simultaneously. Wire 261 renders hot, normally closed switch S3 and via wires 263, 264 normally open switch S8. Current from wire 263 also renders hot switch S7 which when closed supplies current via wire 275 to open switch Sw6*b*.

Switch S7 is on the frame 10 in a position to be depressed to detect the presence of a container in container 21*b* position and switch S8 is on frame 10 in a position to be depressed to detect a container in container 21*a* position.

If switch S8 is depressed by a container being in the position of container 21*a* it is to be transferred to the position of container 21*b*. Thus, a circuit is made from the hot switch S8, via wire 266 to energize the coil of relay K7. This causes switches Sw7*a* and Sw7*b* to be closed. Sw7*b* is hot and, therefore, forms a hold down circuit, via wire 267 to maintain the coil of relay K7 energized until switch Sw6*b* is thrown.

The closing of switch Sw7*a* supplies high voltage via wire 268 to valve V1. Valve V1 is in the hydraulic line leading from accumulator tank 164 to the single acting cylinder 33 (FIG. 2). When valve V1 is energized, it causes cylinder 33 to retract piston rod 32 to swing arms 27*a*, 27*b* from their full line position in FIG. 2 to their broken line position. This causes delivery of crate or container from the position of container 21*a* to the position of container 21*b* and also to deliver the container in the position of container 21*b* to the container 21*c* position.

Switch S7 controls the energizing of the coil of platform up relay K6. When switch S7 is closed, by a container in the container 21*b* position, a circuit from wire 262 via switch S7 and wire 275 is made for the coil of platform up relay K6. This closes switches Sw6*a* and throws Sw6*b* so as to break the hold circuit of the crate eject relay K7 and deenergize its coil. Thus, when relay K6 is energized, relay K7 is not and hence the plates 115*a*, 115*b*, 115*c*, 115*d* cannot be opened, nor are the switches S7 and S8 effective for actuating solenoid V1 to transfer containers.

The throwing of switch Sw6*b* provides a hold down circuit for the coil of platform up relay K6 via wires 263 and 276, the circuit including the control switch Sw3*a* of relay K3.

With switch Sw6*a* closed, solenoid valve V6 is actuated via wire 277 to open and admit fluid from tank 164 into cylinder 161 to cause the platform to move up, inserting fingers 151*a*, 151*b* up through the holes 156*a*, 156*b*. Valve V6 remains held open until the platform 150 reaches the top. The momentary closing and opening of switch S6 by lugs 171 do not effect the travel since the coil of relay K4 has been de-energized by the previous opening of switch S4*b* when the platform 150 was at the bottom of its travel.

When the top of the travel of platform 150 is reached, switch S3 is opened and switch S4 has been released. Switch S3 thus breaks the hold down circuit for the coil of relay K3 which releases switch Sw3*a* and breaks the hold down circuit for the coil of relay K6. This permits valve V6 to be deenergized.

The releasing of switch S4 closes switch S4*b* and thus relay K4 is programmed for hold down when its coil is pulsed. Switch S5, which signals the platform 150 to go down, is connected to hot wire 215 via wires 280 and 227. When closed, switch S5 thus will pulse the coil of relay K4 via wire 271, switch S4*b* and wire 270. This closes switches Sw4*a* and Sw4*b*. Switch Sw4*a* makes a circuit via wire 281 to open solenoid valve V5 and move the platform 150 downwardly. The hold down circuit of switch Sw4*b*, via wire 273 switch S6*a* wire 272, switch S4*b* to wire 270 is also made. Hence the valve V5 remains open until lug 171 trips switch S6 and opens switch S6*a* to dropout relay K4.

Switch S5 is on frame 11 in a position to detect that the egg cartons 100 have been released by the slide plates 115*a*, 115*b*, 115*c*, 115*d* and received in the stacking zone therebelow. Switch S5 is thus adjacent the downward path of an outside egg carton 100 and immediately below the plane slide plates 115*c* and 115*d* so as to be depressed momentarily each time a layer is deposited in the stacking zone.

At this stage, relay K3 has dropped out and the platform 150 is moving downwardly. Thus, current is supplied again via switch Sw3*a* and wire 236 to render switch S1*a* hot. Hence, if or when switch S1 is released, inducting the closing or closed condition of the trays or slide plates 115*a*, 115*b*, 115*c*, 115*d*, switch S1*a* will render the switches To9*a*, To9*b*, To9*c*, To9*d*, To9*e*, To9*f* hot.

When the slide plates were opened, relay K1 was energized. Switch S2*a* is closed, until the slide plates are fully closed. Switch S2*a* provides a hold down circuit, via switch Sw1*b*, wire 285, and wire 243 to maintain relay K1 energized until switch S2 is depressed, at which time switch S2*a* is opened to dropout relay K1 and switch S2*b* is closed. Switch S2*b* applies current to relay K2 and hence the system is again ready and again begins receiving egg cartons 100 in the storage zone, since switch Sw1*b* supplied current via the To9 switches for energizing relay K5 to operate valve V2 for operating the conveyor motor 163.

Figure 6:
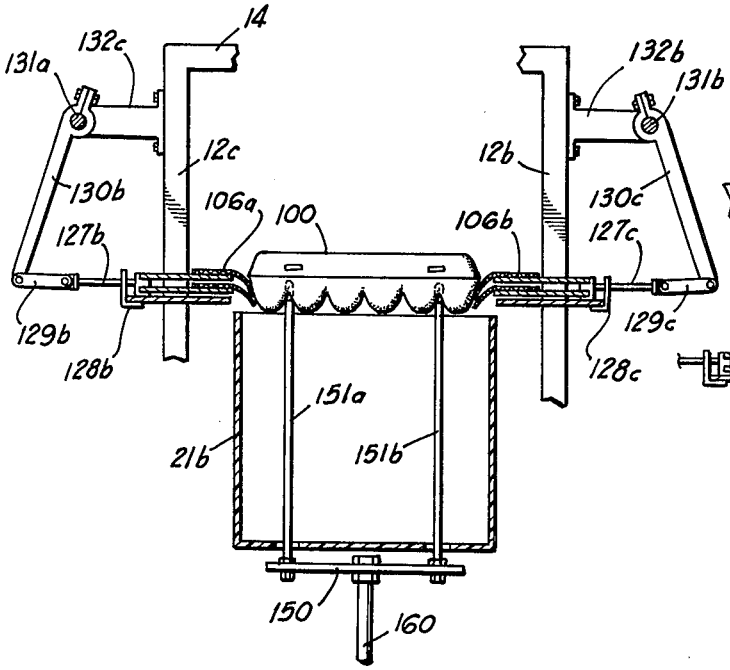
FIG. 6 is a vertical sectional schematic diagram of a crate receiving a first layer of cartons in the machine of the present invention.
Figure 8:
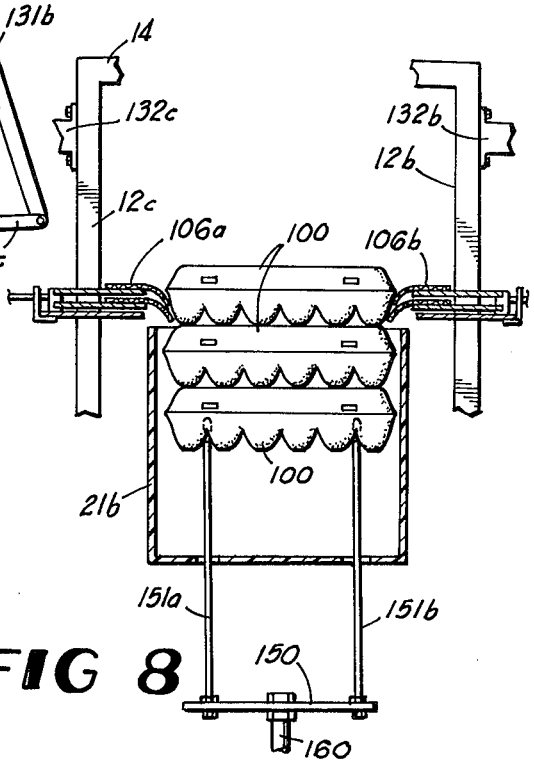
FIG. 8 is a view similar to FIGS. 6 and 7 but showing a third layer of cartons being received on the second layer.
Figure 7:
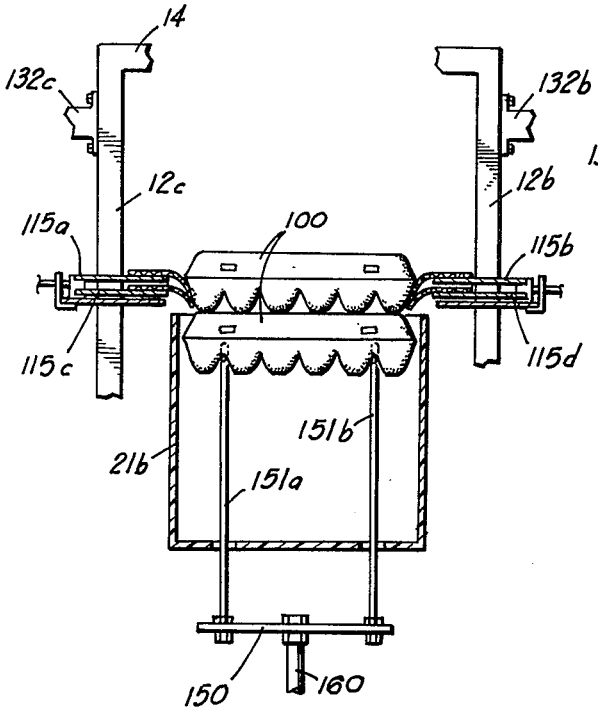
FIG. 7 is a view similar to FIG. 6 but showing a second layer of the cartons being received on the first layer.
Figure 9:
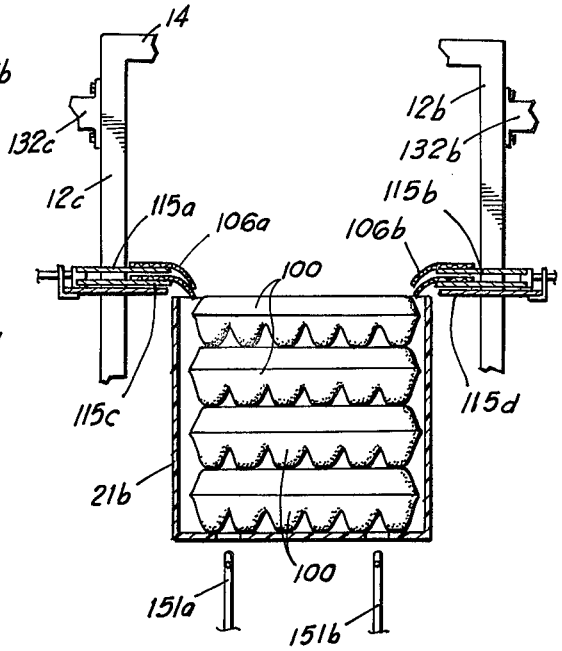
FIG. 9 is a view similar to FIGS. 6, 7 and 8 but showing a fourth layer of cartons being received in the crate.

When the platform 150 moves downwardly, switch S6 is released and the hold down circuit, which includes switches S4*b* and S6*a*, for relay K4 is made. Thus, valve V5 is held open by relay K. Eventually, a lug 171 depresses switch S6 and opens the hold down circuit to de-energize relay K4. Thus, the platform 150 has been lowered by a prescribed amount to dispose rods 151*a*, 151*b* in the one layer position as depicted in FIG. 6. The cartons 100 of the first layer, as previously described, are supported solely by the cross bars 152 and the upper ends 153.

Cycles, for the subsequent layers of cartons 100, are actuated by the accumulation of subsequent layers of cartons 100 in the storage zone, so that the second, third and fourth layers of cartons 100 are respectively accumulated then dropped on top of the first layer and subsequent layers supported by the rods 151*a*, 151*b*.

When the last layer is received, all of the lugs 171 have engaged the switch S6. Therefore, when valve V5 is opened, the platform 150 travels downwardly until it depresses the switch S4, thereby opening the hold down circuit of switch S4*a* for de-energizing relay K4 and closing valve V5.

To assure that the trays or plates 115*a*, 115*b*, 115*c*, 115*d* will not close until after a layer has cleared the space therebetween, switch S6*b* is in series with the tray close control switch Sw2*b*. Thus, even with the switch Sw2*b* closed, until the lug 171 depresses switch S6, for closing switch S6*b* no circuit to open valve V4 is made.

When platform 150 reaches the bottom of its travel, depressing switch S4, the rods 151*a*, 151*b* are totally withdrawn from the container 21*b*, and the container 21*b* is depressing switch S7, the container having been filled with two dozen cartons 100 and, therefore, ready for discharge. Switch S4 signals this operation in that when switch S4*a* is closed relay K3 is energized via wires 229, 263, 262 and switch Sw3*a* is thrown. Thus a circuit via wires 261, 264, switch S8 and wire 266 is made, energizing relay K7. Relay K7 opens valve V1 to actuate cylinder 33. Thus, an empty container 21 is in the container 21*b* position and the load cycle is repeated.

What is claimed is:

1. A container loading machine comprising:

(a) a frame having a storage zone;

(b) an infeed conveyor for feeding successive articles along a prescribed path into a storage zone, said infeed conveyor including flexible belt means for receiving and conveying successive articles, and means for driving said belt means;

(c) stop means within said storage zone for arresting the movement of the innermost article and subsequent articles on said belt means;

(d) moveable support means in said storage zone for maintaining said belt means in a transverse plane so as to support the arrested articles in said storage zone;

(e) control means for moving said support means to permit flexing of said belt means to release the accumulated articles in said storage zone; and (f) means below said storage zone for receiving the released articles.

2. The container loading machine defined in claim 1 wherein said flexible belt means includes a pair of spaced, opposed, endless belts, spaced apart sufficiently that they respectively carry only the end portions of said articles when supported by said support means and will be flexed by said article to release the same when said support means is moved.

3. The container loading machine defined in claim 2 wherein said support means is a pair of flat plates respectively beneath flights of said belts and moveable toward and away from each other for selectively supporting and releasing said belts.

4. The container loading machine defined in claim 1 including upstanding rods disposed below said storage zone and moveable in vertical paths upwardly and downwardly, means for moving said rods simultaneously to positions immediately below said storage zone for receiving by their upper ends, said articles which are released by said belt means, and means for progressively lowering said rods for permitting the received articles to receive successive layers of articles from said belt means.

5. The container loading machine defined in claim 4 including container conveyor means for conveying successive empty containers to a position below said storage zone where said rods will project through openings in said container for receiving the successive layers of articles and will lower the articles into the container.

6. The container loading machine defined in claim 5 wherein said container conveyor includes means for retaining a container in a prescribed position below said storage zone, said rods being moveable sufficiently that in their lowermost positions said rods are below said container.

7. An egg carton stacking machine for stacking cartons of eggs, the cartons each being of a type having longitudinally and traversely aligned cells having spaced central bottom recesses surrounded by such cells and traversely aligned valleys between adjacent cells, comprising:

(a) a frame having a storage zone for receiving a plurality of cartons of eggs therein;

(b) an infeed conveyor for feeding cartons of eggs sidewise into said storage zone;

(c) means within said storage zone for arresting the inward movement of said cartons;

(d) means for detecting when the storage zone has been filled by said egg cartons to produce a first layer of cartons;

(e) a plurality of upstanding rods moveable along their axes for positioning their upper ends immediately below said storage zone, pairs of said rods being spaced apart so as to receive a single carton thereon;

(f) support means in said storage zone for retaining the egg cartons until a layer has been produced and for releasing the same onto the ends of said rods;

(g) means for simultaneously lowering said rods by approximately the height of said egg cartons; and (h) means for causing said infeed conveyor to feed additional cartons into said storage to zone and for causing said support means to retain the same so as to produce a second layer of cartons and to release them onto the top of said first layer of cartons.

8. The egg carton loading machine defined in claim 7 wherein each of said rods is provided, adjacent its upper end portion, with a cross bar for receiving and supporting spaced increments of said carton as said end portion of said rod projects into a recess in said egg carton.

9. The egg carton loading machine defined in claim 8 wherein said rods are disposed in alignment longitudinally and transversely of said machine and wherein transversely aligned pairs of said rods are spaced from each other by a distance sufficiently less than the length of said egg carton that said increments of said egg carton are valleys between the cells of the bottom positions of said egg carton on opposite sides of said rod.

10. The egg carton loading machine defined in claim 7 including a cross feed conveyor for conveying empty crates into a loading zone below said storage zone, said rods being moveable in said loading zone so as to be retracted out of the path of said crate and being moveable upwardly through holes in the bottom of said crate for positioning to receive said cartons.

11. In an apparatus for stacking cartons of eggs of the type in which each egg carton contains a pair of spaced downwardly opening recesses defined by the sides of the downwardly protruding egg receiving cells and downwardly opening troughs between adjacent egg receiving cells outwardly of each recess, the combination of:

(a) a pair of spaced upstanding rods moveable axially in vertical paths, said rods being spaced apart by a distance approximately equal to the distance between said recesses of said egg cartons, means on said upstanding rods for supporting said cartons by respectively receiving the recesses of the cartons on the ends of said rods; and (b) means for depositing said egg cartons onto the ends of said rods.

12. In an apparatus for stacking egg cartons of the type wherein the egg cartons are accumulated into successive layers in a storage zone and then successively stacked on each other, the combination therewith of:

(a) a pair of spaced opposed conveyor belts for conveying the egg cartons sidewise into the storage zone by their opposed end portions; and (b) moveable support means for selectively supporting or not supporting portions of said conveyor belts, said portions of said belts being sufficiently flexible that when they are not supported they will release said cartons.

13. An egg carton stacking machine for stacking cartons of eggs comprising:

(a) a frame having a storage zone for receiving a plurality of cartons of eggs therein;

(b) an infeed conveyor for feeding cartons of eggs sidewise into said storage zone;

(c) means within said storage zone for arresting the inward movement of said cartons;

(d) means for detecting when the storage zone has been filled by said egg cartons;

(e) a plurality of upstanding rods moveable along their axes for positioning their upper ends immediately below said storage zone;

(f) support means in said storage zone for retaining the egg cartons and for releasing the same onto the ends of said rods; and (g) said support means including a pair of spaced opposed horizontally disposed, slide plates and wherein said infeed conveyor includes spaced endless, flexible conveyor belts, flights of which carry successive egg cartons by their end portions and pass over said slide plates, said slide plates being retractable from each other for permitting said belts to flex and release said cartons.

14. An apparatus for loading egg cartons into a crate, the egg cartons each being of the type having spaced recesses or valleys between cells in its bottom portion, the crates being of a type having holes in its bottom portion, the apparatus comprising:

(a) crate support means for supporting said crate in a presented position;

(b) a plurality of upstanding rods;

(c) rod moving means for moving said upstanding rods, said rods moving means being disposed below said crate support means, said rods being secured to said rod moving means by their lower ends with their axes being parallel to each other;

(d) carton support means for disposing said cartons as layers side by side abutting position and for supporting said cartons in positions above the open end of said crate;

(e) said rods having upper end terminating in a common horizontal plane, their upper ends, with means for receiving and supporting each of said egg cartons at spaced locations along the bottom of each carton, the upper end being received in said recesses or valleys of said cartons, said rods being simultaneously moveable axially by rod moving means through the openings in the bottom of said crate and into an uppermost position in a plane below the bodies of said egg cartons, in a first layer the space between the egg cartons and said support means and the upper ends of said rods being essentially unobstructed;

(f) means for causing said support means to release the supported egg cartons onto the ends of said rod during a first cycle; and (g) means for progressively lowering said rod moving means and for causing said carton support means to support subsequent layers of egg cartons and for releasing accumulated egg cartons in subsequent layers onto the tops of the egg cartons of the preceeding layers whereby a stack of a plurality of layers of egg cartons are lowered into said crate; and (h) means for removing a crate which has been loaded with egg cartons from said crate support means and for replacing it with an empty crate.

15. Process of loading egg cartons containing eggs therein into a crate, each egg carton being of the type leaving spaced valleys or recesses in its bottom portion, comprising:

(a) positioning said crate with an open top portion in a prescribed position in a loading zone;

(b) passing said egg cartons successively along a prescribed path into said loading zone;

(c) accummulating said cartons for producing a first layer in said loading zone;

(d) extending rods axially in parallel paths up through said crate at distances from each other corresponding to the spacing of the valleys or recesses of the cartons in the first layer so that the upper ends of said rods are aligned with said valleys or recesses of said egg cartons of said first layer;

(e) releasing the cartons of said first layer onto the ends of said rods so that they are solely supported by said rods; and (f) lowering said rods and depositing additional layer or layers of cartons on said first layer whereby a plurality of layers of egg cartons are accummulated and received in said container.

16. The process defined in claim 15 wherein each of said egg cartons is supported by their opposite end portions above said crate and is released unimpeded to drop during the period in which the carton becomes part of a layer of such egg cartons supported by said rods.

17. The process defined in claim 15 including replacing the crate which has been filled with layers of egg cartons is replaced with a replacement empty crate and the operation is repeated for filling the replacement crate.

* * * * *